US007057121B2

(12) United States Patent
Herrero Pellicer et al.

(10) Patent No.: US 7,057,121 B2
(45) Date of Patent: Jun. 6, 2006

(54) LOW-CURRENT STARTER SWITCH FOR VEHICLES AND STARTER GEAR COMPRISING SAID SWITCH

(75) Inventors: Jose Antonio Herrero Pellicer, Barcelona (ES); Miquel Plana Bague, Barcelona (ES)

(73) Assignee: Valeo Sistemas De Seguridad S.A., Oleasa De Monserrat (ES)

( * ) Notice: Subject to any disclaimer, the term of this patent is extended or adjusted under 35 U.S.C. 154(b) by 0 days.

(21) Appl. No.: 10/479,574

(22) PCT Filed: Jun. 17, 2002

(86) PCT No.: PCT/EP02/06632

§ 371 (c)(1),
(2), (4) Date: Dec. 4, 2003

(87) PCT Pub. No.: WO02/103732

PCT Pub. Date: Dec. 27, 2002

(65) Prior Publication Data

US 2004/0154905 A1 Aug. 12, 2004

(30) Foreign Application Priority Data

Jun. 18, 2001 (ES) ..... 200101408

(51) Int. Cl.
*H01H 27/06* (2006.01)

(52) U.S. Cl. ..... 200/43.03; 200/11 DA; 307/10.3

(58) Field of Classification Search ..... 200/11 C, 200/11 D, 11 DA, 11 R, 43.03, 43.04, 43.08, 200/43.11, 336, 564, 570, 571; 307/10.2, 307/10.3, 10.4; 361/772–774, 58; 338/200, 338/215

See application file for complete search history.

(56) References Cited

U.S. PATENT DOCUMENTS

| | | | | |
|---|---|---|---|---|
| 3,651,288 | A * | 3/1972 | Cryer | 200/43.07 |
| 3,680,335 | A * | 8/1972 | Onishi | 70/252 |
| 3,863,212 | A * | 1/1975 | Nyc | 200/43.08 |
| 3,873,891 | A | 3/1975 | Gerber | |
| 4,527,024 | A | 7/1985 | Lai | |
| 4,801,914 | A | 1/1989 | Kerai | |
| 5,622,148 | A * | 4/1997 | Xue et al. | 123/179.25 |
| 5,773,774 | A | 6/1998 | Ramamurthy | |
| 5,811,747 | A * | 9/1998 | Taniguchi et al. | 200/61.88 |
| 5,969,307 | A * | 10/1999 | Lacroix et al. | 200/11 B |
| 6,122,944 | A | 9/2000 | Chandra et al. | |

FOREIGN PATENT DOCUMENTS

FR 2590533 A1 * 5/1987

* cited by examiner

*Primary Examiner*—Elvin Enad
(74) *Attorney, Agent, or Firm*—Berenato, White & Stavish LLC

(57) ABSTRACT

A low-current starter switch (1) for vehicles, includes a rotor (3;3') fixed to an anti-theft cylinder and an electrical circuit. The electrical circuit is low current with a variable resistance, depending on the annular position of the rotor (3;3'), and provides an output voltage ($V_x$) which varies as a function of the resistance.

3 Claims, 4 Drawing Sheets

LOW-CURRENT STARTER SWITCH FOR VEHICLES AND STARTER GEAR COMPRISING SAID SWITCH

DESCRIPTION

The present invention relates to a low-current starter switch for vehicles, of the type comprising a rotor, fixed to the anti-theft cylinder with regard to rotation, and an electrical circuit.

The invention also relates to starter gear for vehicles, comprising said starter switch.

PRIOR ART

Starter switches are normally high-power switches: in other words, they have contact elements and conducting tracks arranged in such a way as to permit direct opening and closing of the electrical contact between the battery and the starter, the accessories, etc., in each angular position of the switch rotor.

Other switches have been developed which have a similar configuration to the preceding switches, but which, instead of directly opening and closing the contact between the battery and the circuits to be activated, connect or disconnect corresponding relays, each of which is associated with a circuit.

The known switches have drawbacks associated with their size.

The principal problems are due to the use of a power switch: in the first place, the switch is an expensive part which is subject to power requirements, and requires the use of complex materials and design procedures. In all cases, the quality of the electrical contact must be maintained in the face of problems associated with friction, wear, free dielectric particles, oil and similar factors, with the additional constraint of using high-power contacts, particularly in the case of the starter, whose power consumption is very high. Another problem is that the switch is not a standard part; indeed, each application requires a separate design, thus increasing the development and production costs.

Moreover, the systems which have been described require power cables of considerable length, especially when no relays are present; this increases the cost of the assembly and leads to problems of space, because of the significant diameter of the cables.

DESCRIPTION OF THE INVENTION

The object of the present invention is to overcome the aforesaid problems by developing a widely applicable low-current starter switch which is not subject to complicated requirements in respect of design and construction.

According to this object, the starter switch of the present invention is characterized in that said electrical circuit has a low current and a variable resistance depending on the angular position of the rotor, and delivers an output voltage which varies as a function of said resistance.

Because of these characteristics, the switch can be used to generate reliable signals indicating the position of the anti-theft device, according to which the various items of electrical equipment of the vehicle will be activated; consequently no high currents flow in the switch, and the requirements in terms of design and materials are greatly simplified.

In particular, the switch is not subject to problems such as wear, friction, free dielectric particles and the like which arise in power switches.

Moreover, the components can be the same for different applications, making the switch suitable for a wide range of uses.

These advantages also significantly reduce the development and production cost of the switch, by comparison with the power switches used up to the present time.

In a first embodiment of the invention, said electrical circuit comprises a printed circuit board having at least two resistors in series, at least one sliding contact, fixed to the rotor as regards rotation, being provided to make contact with the tracks of the printed circuit to short-circuit at least one of the resistors when the rotor occupies predetermined angular positions.

This embodiment is simple and reliable, and also enables peaks or variations of the power supply to be absorbed.

The electrical circuit preferably comprises a printed circuit board having three resistors in series, and is characterized in that the sliding contact short-circuits one resistor when the rotor occupies first predetermined angular positions and short-circuits two resistors when the rotor occupies second predetermined angular positions.

In this case, the resulting output voltage may have three different values, making it possible to provide reliable separation between an "off" position, an "on" position and a "start" position.

Advantageously, the printed circuit board comprises two independent electrical circuits and two independent sliding contacts, fixed to the rotor with regard to rotation, each of which is associated with one of the electrical circuits of the printed circuit board; in one embodiment, one of said independent electrical circuits is an all-or-nothing circuit.

The second electrical circuit enables the operating equipment to be kept in an inactive state until the user turns the key in the anti-theft device.

Optionally, each sliding contact can consist of a metal plate fixed to a face of the rotor and having at least one finger for contact with the tracks of the printed circuit; in this case, each sliding contact advantageously has at least two contact fingers having different geometries, which act simultaneously on a single track of the printed circuit, in such a way as to ensure contact in any situation, particularly if problems of resonance occur.

In a second embodiment of the invention, said electrical circuit consists of at least one rotary potentiometer.

This embodiment is extremely simple and inexpensive, since all its components are standard and low-priced.

The resistance of the said potentiometer is preferably variable in ranges, having a set of different discrete values, each of which is kept constant over the whole extent of an angular interval.

This characteristic provides great reliability in operation, while avoiding uncertainty when the voltage is read.

Optionally, two potentiometers can be included in this embodiment, both being associated with the rotary movement of the motor and deliver independent output voltages; thus, faults in one of the components can be detected simply by comparing the signals of the two potentiometers.

The invention also relates to starter gear for vehicles, comprising a starter switch, characterized in that said starter switch is of the type defined above and in that it additionally comprises a control circuit connected, on the one hand, to the output of the variable resistance electrical circuit of the switch and, on the other hand, to at least two relays, said control circuit activating each of the relays according to the output voltage of the variable resistance electrical circuit.

Overall, the starter gear is much less expensive and is subject to fewer requirements than conventional power switches, and also provides a significant saving in power cable, with a corresponding reduction of the cost of the gear and of the space occupied by it in the vehicle.

For different power levels, it will only be necessary to change the relays, which are inexpensive standard components; the same consideration applies to variations of the operating parameters for starting the vehicle, since in this case it will only be necessary to change the electronic components of the control circuit.

BRIEF DESCRIPTION OF THE DRAWINGS

For a clearer understanding of what has been described, drawings have been attached, showing schematically a practical case of embodiment provided solely by way of example and without restrictive intent.

In these drawings.

DESCRIPTION OF PREFERRED EMBODIMENTS

Figure 1:
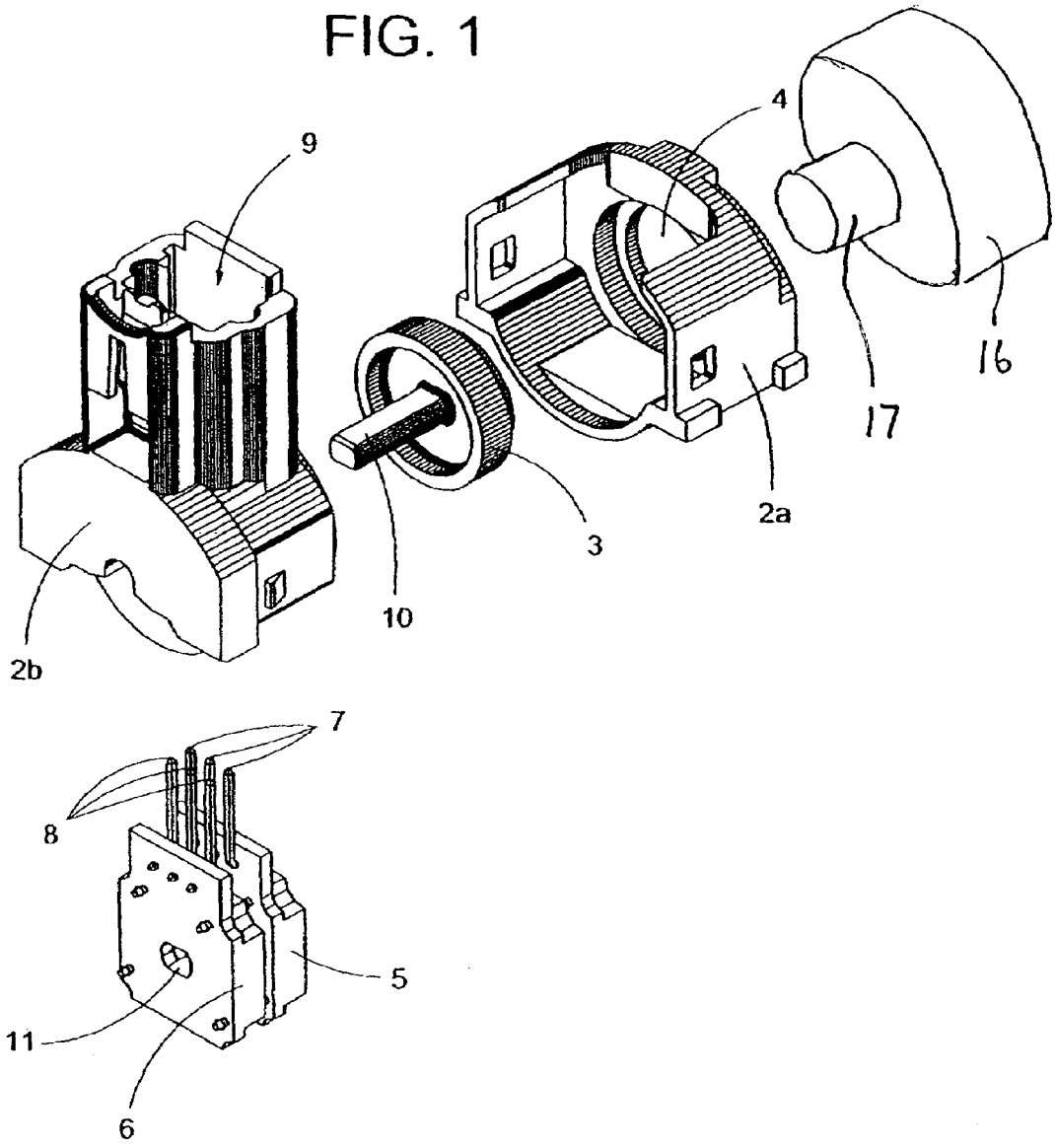
FIG. 1 is an exploded perspective view of a starter switch according to a first embodiment of the invention.

A starter switch 1 according to the invention, as shown in the exploded view of FIG. 1, comprises a casing which houses the components of the switch 1 and is formed from two parts 2*a* and 2*b* joined together by a system of elastic tabs.

Inside the casing 2*a*, 2*b* there is a rotor 3, one of whose ends is accessible from the outside through an opening 4 in part 2*a* of the casing. This end of the rotor 3 accessible from the outside of the casing has a shape (not visible in FIG. 1) which is adapted for coupling to a distal end of to a cylinder 17 of to a anti-theft device 16 of the vehicle (shown in FIG. 1); thus, when the user turns the key in the anti-theft device 16, the rotary motion is transmitted to the rotor 3.

The switch is fitted permanently in the steering column of the vehicle, in such a way that the axis of the rotor 3 is aligned with the axis of the anti-theft device.

In the embodiment shown in FIG. 1, the switch 1 additionally comprises two rotary potentiometers 5 and 6, of a known type, housed within part 2*b* of the casing and having their connecting lugs 7 and 8 respectively accessible from the outside of the casing through an opening 9 formed in the casing.

The rotor 3 comprises a driving shaft 10, of non-rounded cross section, adapted to rotate the potentiometers 5 and 6 by having a shape which fits into apertures 11 of the potentiometers.

The potentiometers 5 and 6 are of the type with a stepped voltage output: in other words, the output voltage does not increase in a linear way with the angle of rotation, but has a series of different discrete values, each of which is constant over a range of angles of rotation.

Figure 2:
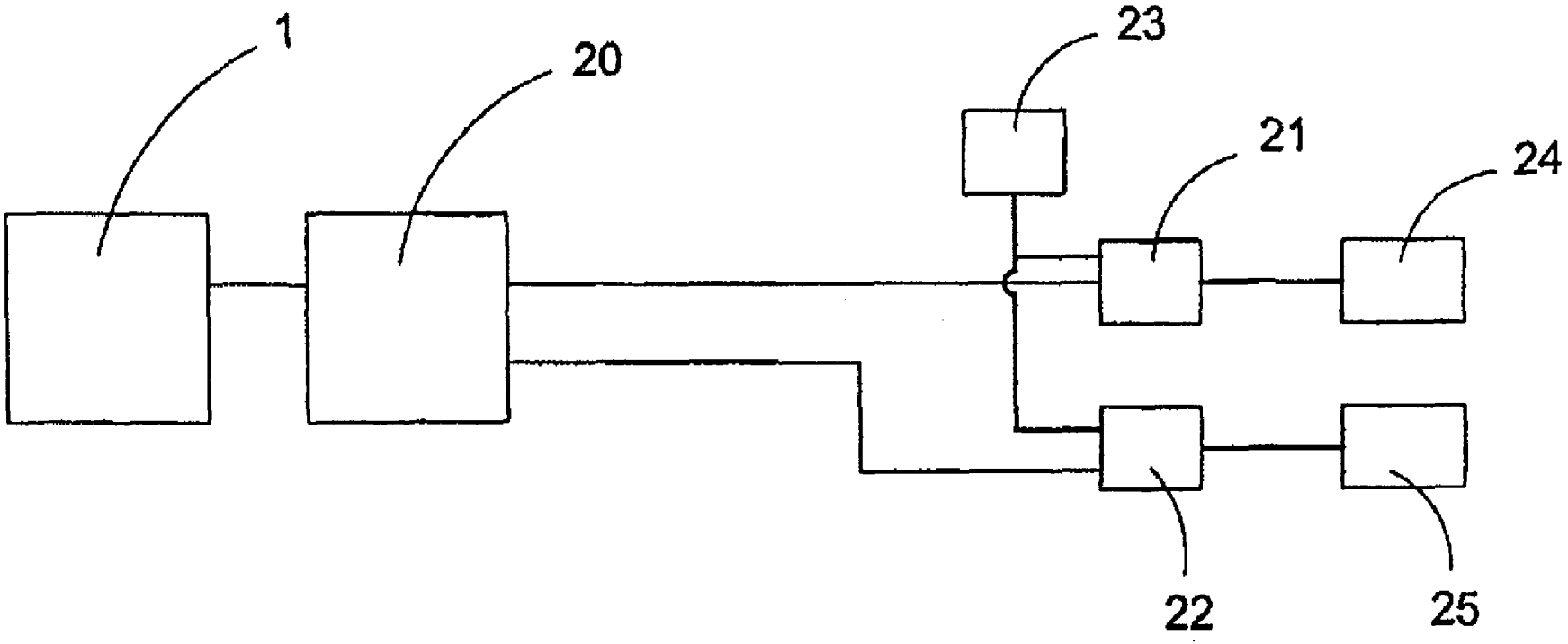
FIG. 2 is a connection diagram of a starting system incorporating a switch according to the invention.

As shown by the connection diagram of FIG. 2, the switch 1 is connected to a control circuit 20 through the lugs 7 and 8 of the potentiometers 5 and 6.

The control circuit 20 is responsible for reading the voltage supplied by the potentiometers at each instant, and, according to this voltage, for causing the activation of relays 21, 22 connected to the battery 23: in this embodiment, for example, the relay 21 is responsible for putting the electrical equipment, for example the windscreen washers, the air conditioning, the radio, etc., into the "on" state 24, while the relay 22 activates the starter 25.

The relays 21 and 22 are located near the elements which they are to activate; the quantity of power cable (shown in heavy lines in FIG. 2) required for the installation is therefore minimized. The rest of the cables (shown in light lines) are signal transmission cables and can therefore be much thinner.

In the embodiment illustrated, two identical potentiometers 5 and 6 have been incorporated in order to increase the reliability of the system and enable it to be tested: the readings from the two potentiometers must be identical, and the detection of a difference indicates the failure of one of them. Clearly, however, this characteristic is not limiting, and a single potentiometer would be perfectly capable of meeting the requirement to provide different voltage levels for different angles of rotation of the anti-theft device.

Figure 3:
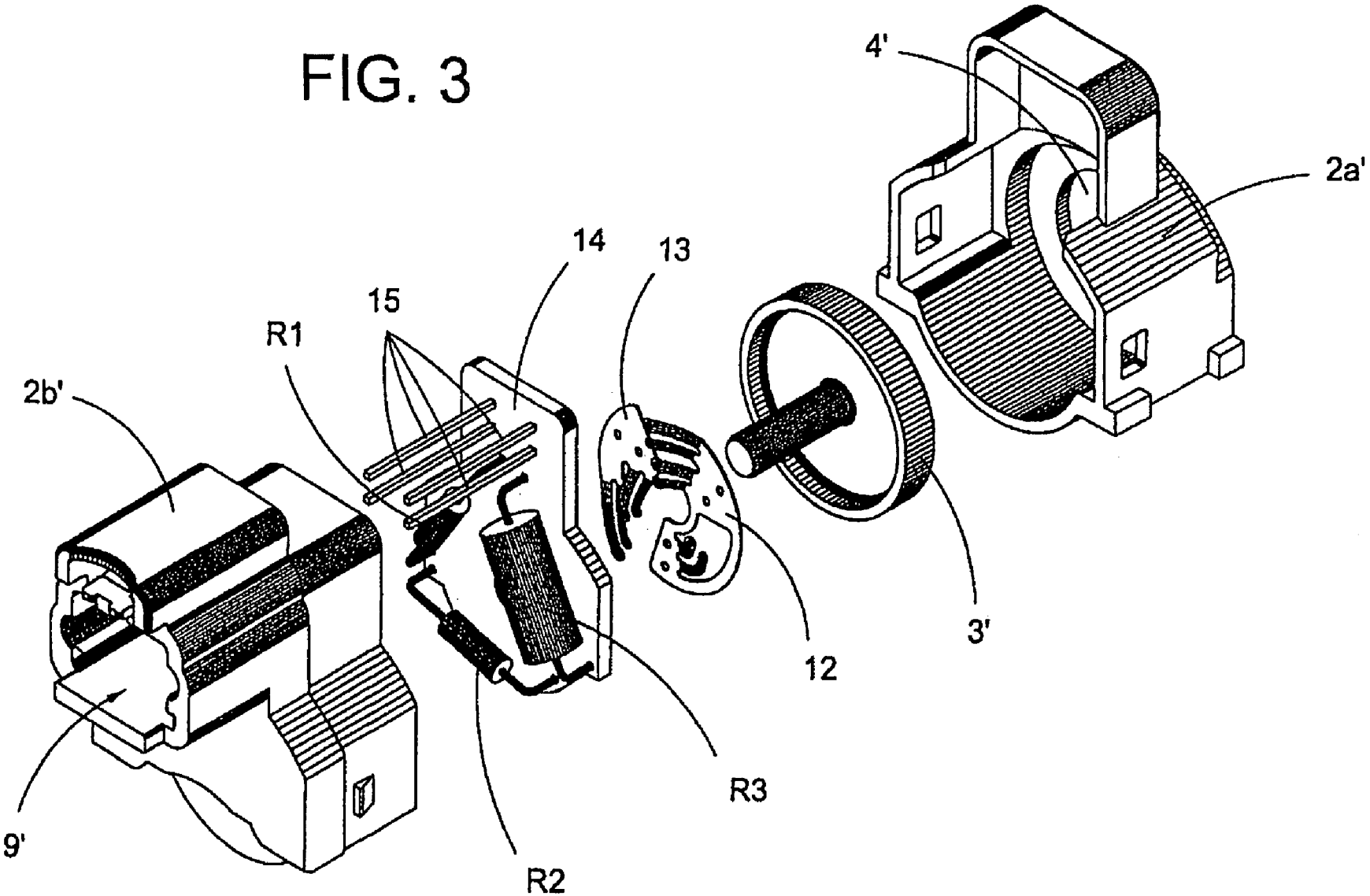
FIG. 3 is a view similar to FIG. 1, showing a switch according to a second embodiment of the invention.

FIG. 3 shows a variant embodiment of the switch according to the invention.

In this case, the casing 2*a*', 2*b*' and the rotor 3' are slightly different because they are adapted to the shapes of the internal elements of this variant of the switch.

The potentiometers 5, 6 of the switch of FIG. 1 have been replaced here by other components performing a similar function.

A pair of independent sliding contacts 12 and 13 are fixed to the rotor, each consisting of a small metal plate having a set of double fingers designed to project from the plane of the plate; these fingers are designed to slide on the tracks of a printed circuit (not visible in the figure) formed on a corresponding board 14.

The function of the fingers 12 and 13 is to interconnect different points of the printed circuit, according to the position of the rotor 3' to which they are fixed, in a way which is explained below.

Connecting lugs 15 and three resistors $R_1$, $R_2$ and $R_3$ are also positioned on the printed circuit board 14, and are connected to suitable points of the circuit tracks; the resistors are connected in series through the printed circuit.

The connecting lugs 15 are accessible from the outside of part 2*b*' of the casing through a suitable opening 9'.

The block diagram of an installation incorporating this switch is identical to that shown in FIG. 2, with the exception of part of the control circuit 20 which is changed as a result.

The operation of the switch of FIG. 3 will now be described in greater detail, with reference to the diagram of FIG. 4.

The resistors $R_1$, $R_2$ and $R_3$ are connected in series and are supplied through another resistor $R_0$ with a stabilized voltage, for example +5 V. In FIG. 4, the references $P_1$ and $P_2$ represent two tracks of the printed circuit formed on the board 14 (FIG. 3); two fingers of the sliding contact 12, which is shown schematically by a line in FIG. 4, slide on each of the tracks $P_1$ and $P_2$.

The provision of two contact fingers for each track, rather than one, is not essential but offers the advantage of ensuring good contact, particularly in conditions of resonance, since the differences in geometry between the two fingers avoids the risk of simultaneous resonance of the fingers.

Figure 4:
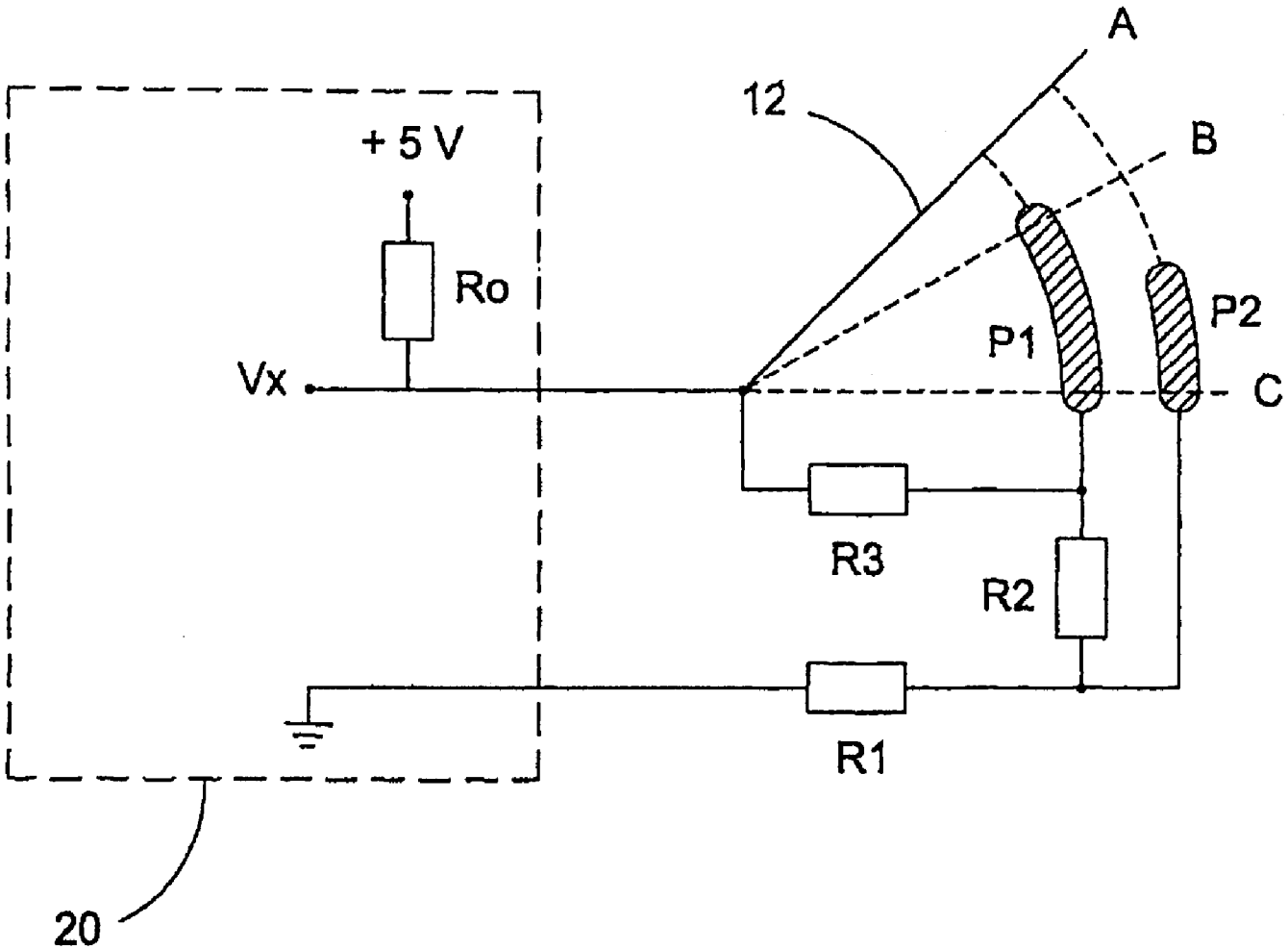
FIG. 4 is a connection diagram of the resistors and other elements of the switch of FIG. 3.

As will be understood from FIG. 4, the circuit forms a voltage divider, in which the voltage $V_x$ read by the control circuit depends on the position of the sliding contact 12 and consequently on the angle of rotation of the key in the anti-theft device: when the anti-theft device is in position A (before the user has turned the key), the electrical circuit is formed by the three resistors $R_1$, $R_2$ and $R_3$; when the anti-theft device is in position B (when the user has turned the key to the "on" position), the sliding contact 12 short-circuits resistor $R_3$ by making contact with the track $P_1$, and the circuit is then formed by resistors $R_1$ and $R_2$; and when the anti-theft device is in position C (when the user has turned the key to the "start" position), the sliding contact 12 short-circuits resistors $R_2$ and $R_3$ by making contact with the track $P_2$, and the circuit is then formed by the resistor $R_1$ only.

The different resistances of the electrical circuit cause the voltage $V_x$ to be different in each of the three positions "off", "on" and "start"; for example, in a practical embodiment, the values of the voltage $V_x$ for the three positions could be approximately 3.5 V (off), 2.4 V (on) and 1.3 V (start).

On the basis of the voltage read, the circuit 20 activates the relays and electrical equipment which have been described.

It should be emphasized that each of the voltages is kept constant between two given angles of rotation of the anti-theft device, and the reliability of the system is therefore very high.

In a second variant embodiment of the switch, an electrical circuit of the all-or-nothing type is again provided, but is not illustrated, since its design is self-evident to those skilled in the art; this circuit is designed to "wake up" the control circuit 20 when the anti-theft device is set to the "on" position, for this all-or-nothing circuit, the sliding contact 13 (FIG. 3) is used, this contact turning, as explained, jointly with the sliding contact 12 while remaining electrically independent of the latter.

The embodiment comprising conventional potentiometers, shown in FIG. 1, has the advantage of being extremely simple in terms of construction, and very economical; however, the embodiment of FIG. 3 is more reliable, since it can absorb any peak of power or variation of the power supply.

What is important in both embodiments is that the switch comprises means of varying a voltage according to the angle of rotation of the anti-theft device (these means are the potentiometer in one case and the combination of the sliding contacts, the printed circuit and the resistors in the other case), and that the control circuit governs the activation of the various electrical systems of the vehicle according to this voltage, in such a way that only a low current flows in the switch.

Although a particular embodiment of the present invention has been described and illustrated, it is clear that a person skilled in the art will be able to make variations and changes, or replace elements by technically equivalent ones, without departing from the scope of protection defined by the attached claims.

The invention claimed is:

1. A low-current starter switch (1) for a steering column lock of a vehicle, said starter switch comprising:

a rotor (3; 3') coaxially drivingly coupled to a cylinder of an anti-theft device with regard to rotation thereof, and an electrical circuit having a low current variable resistance depending on the angular position of said rotor (3; 3'), and delivering an output voltage ($V_x$) which varies as a function of said resistance, said rotor rotatable by said cylinder of said anti-theft device;

said switch (1) being electrically connectable to a starter of said vehicle for controlling said starter;

wherein said electrical circuit consists of at least two rotary potentiometers (5, 6), both associated with the rotary movement of said rotor (3; 3') and delivering independent output voltages.

2. The starter switch as claimed in claim 1, wherein the resistance of said potentiometers (5, 6) is variable in ranges, having a series of different discrete values, each of which is kept constant throughout the extent of one angular interval.

3. Starter switch (1) as defined in claim 1, further comprising a control circuit (20) connected, on the one hand, to the output of said variable resistance electrical circuit of said switch (1) and, on the other hand, to at least two relays (21, 22), said control circuit (20) activating each of said relays (21, 22) according to the output voltage of said variable resistance electrical circuit.

* * * * *